US009394079B2

(12) United States Patent
Weyrauch

(10) Patent No.: US 9,394,079 B2
(45) Date of Patent: Jul. 19, 2016

(54) PALLET CONTAINER

(71) Applicant: MAUSER-WERKE GMBH, Brühl (DE)

(72) Inventor: Detlev Weyrauch, Kreuzau-Untermaubach (DE)

(73) Assignee: MAUSER-WERKE GMBH, Bruehl (DE)

( * ) Notice: Subject to any disclaimer, the term of this patent is extended or adjusted under 35 U.S.C. 154(b) by 0 days.

(21) Appl. No.: 14/430,142

(22) PCT Filed: Sep. 13, 2013

(86) PCT No.: PCT/EP2013/002762

§ 371 (c)(1),
(2) Date: Mar. 20, 2015

(87) PCT Pub. No.: WO2014/044374

PCT Pub. Date: Mar. 27, 2014

(65) Prior Publication Data

US 2015/0239610 A1 Aug. 27, 2015

(30) Foreign Application Priority Data

Sep. 21, 2012 (DE) ..... 20 2012 009 326 U

(51) Int. Cl.
*B65D 19/44* (2006.01)
*B65D 77/04* (2006.01)
*B65D 90/00* (2006.01)

(52) U.S. Cl.
CPC ..... *B65D 19/44* (2013.01); *B65D 77/0466* (2013.01); *B65D 90/004* (2013.01); *B65D 2519/00815* (2013.01); *B65D 2590/0066* (2013.01)

(58) Field of Classification Search
CPC ..... B65D 2519/00288; B65D 19/44; B65D 7/20; B65D 7/26; B65D 77/0466
USPC ..... 108/55.1, 55.3, 55.5, 51.11; 206/386; 220/23.91, 485
See application file for complete search history.

(56) References Cited

U.S. PATENT DOCUMENTS 1,555,022 A * 9/1925 Proctor ..... 108/55.1
3,015,407 A * 1/1962 Fesmire et al. ..... 220/1.5
3,106,377 A * 10/1963 Cotton ..... 410/116
3,480,174 A * 11/1969 Sherwood ..... 108/55.1

(Continued)

FOREIGN PATENT DOCUMENTS

EP 2 418 391 A1 2/2012

OTHER PUBLICATIONS

International Search Report issued by the European Patent Office in International Application PCT/EP2013/002762.

*Primary Examiner* — Jose V Chen
(74) *Attorney, Agent, or Firm* — Henry M. Feiereisen LLC.

(57) ABSTRACT

A pallet container for storing and transporting in particular hazardous liquid filling materials, includes an exchangeable plastics inner container and a supporting casing which closely encloses the plastics inner container and is made of a tubular lattice frame which is fastened to the upper outer rim on the pallet top deck of a rectangular bottom pallet. A transportation securing eye made of metal is provided and fastened on the pallet top deck of the bottom pallet (12) in each of all four corner regions externally at the bottommost horizontally peripheral lattice tube of the tubular lattice frame.

8 Claims, 3 Drawing Sheets

(56) References Cited

U.S. PATENT DOCUMENTS

| | | | | | |
|---|---|---|---|---|---|
| 3,753,407 | A * | 8/1973 | Tilseth | 108/55.5 |
| 3,779,502 | A * | 12/1973 | Marberg | 410/116 |
| 5,180,263 | A * | 1/1993 | Flowers, Jr. | 410/106 |
| 5,253,777 | A * | 10/1993 | Schutz | 206/386 |
| 5,398,832 | A * | 3/1995 | Clive-Smith | 108/55.3 |
| 5,507,237 | A * | 4/1996 | Barrow et al. | 108/55.1 |
| 5,725,118 | A * | 3/1998 | Slager et al. | 220/4.28 |
| 5,899,337 | A * | 5/1999 | Thebeault | 206/600 |
| 5,924,589 | A * | 7/1999 | Gordon | 220/23.91 |
| 6,024,237 | A * | 2/2000 | Burgdorf et al. | 220/23.91 |
| 6,202,844 | B1 * | 3/2001 | Sedlmayr | 206/386 |
| 6,276,285 | B1 | 8/2001 | Ruch | |
| 6,290,082 | B1 * | 9/2001 | Van Giezen et al. | 220/23.91 |
| 6,357,365 | B1 * | 3/2002 | Higgins et al. | 108/55.1 |
| 6,550,628 | B1 * | 4/2003 | Sedlmayr | 220/23.91 |
| 6,644,220 | B2 * | 11/2003 | Gangloff et al. | 108/55.1 |
| 6,668,735 | B2 * | 12/2003 | Cassina | 108/55.1 |
| 7,296,374 | B2 | 11/2007 | Weyrauch et al. | |
| 7,565,868 | B2 * | 7/2009 | Relland | 108/55.1 |
| 7,908,980 | B2 | 3/2011 | Schmidt et al. | |
| 8,256,615 | B2 * | 9/2012 | Goda | 108/55.1 |
| 8,505,469 | B2 * | 8/2013 | Liu et al. | 108/55.1 |
| 8,863,978 | B2 | 10/2014 | Przytulla et al. | |
| 8,875,894 | B2 * | 11/2014 | Ness | 108/55.3 |
| 2003/0015529 | A1 * | 1/2003 | Przytulla | 220/23.91 |
| 2006/0011637 | A1 | 1/2006 | Schmidt et al. | |
| 2009/0008397 | A1 | 1/2009 | Schmidt et al. | |
| 2009/0241809 | A1 * | 10/2009 | Head | 108/55.1 |
| 2010/0101460 | A1 * | 4/2010 | Kelly et al. | 108/55.3 |
| 2010/0200579 | A1 | 8/2010 | Schmidt et al. | |
| 2012/0037528 | A1 | 2/2012 | Schütz | |

* cited by examiner

PALLET CONTAINER

CROSS-REFERENCES TO RELATED APPLICATIONS

This application is the U.S. National Stage of International Application No. PCT/EP2013/002762, filed Sep. 13, 2013, which designated the United States and has been published as International Publication No. WO 2014/044374 and which claims the priority of German Patent Application, Serial No. 20 2012 009 326.6, filed Sep. 21, 2012 pursuant to 35 U.S.C. 119(a)-(d).

BACKGROUND OF THE INVENTION

The present invention relates to a pallet container for storing and transporting in particular hazardous liquid filling materials, having an exchangeable plastics inner container and a supporting casing which closely encloses the plastics inner container and is made of a tubular lattice frame which is fastened to the upper outer rim of a rectangular pallet, wherein the pallet has a flat pallet top deck for supporting the fitted plastics inner container, and a pallet substructure having corner and middle feet.

The pallet is equipped, between the corner and middle feet, with in each case a corresponding recess for the insertion of the forks of a fork-lift truck. The pallet can be passed beneath from all four sides in the longitudinal or transverse direction. Filled pallet containers having a filling volume of approximately 1000 liters with a conventional pallet size of 1200 mm×1000 mm can have a weight of well over 1 t, depending on the specific weight of the liquid filling material, and are only able to be handled with fork-lift trucks.

PRIOR ART

For such lightweight composite pallet containers of the present kind without solid metal frames and corner posts there have hitherto been no particular constructive devices for optimal transportation securing. All that are known, in the case of steel pallets, are through-openings in the corner feet themselves, which consist of solid sheet steel.

SUMMARY OF THE INVENTION

Objective

It is the object of the present invention to propose a pallet container of the generic type with a particular configuration with regard to greater transportation security.

Solution

This object is achieved by a pallet container for storing and transporting in particular hazardous liquid filling materials, having an exchangeable plastics inner container and a supporting casing which closely encloses the plastics inner container and is made of a tubular lattice frame which is fastened to the upper outer rim on the pallet top deck of a rectangular bottom pallet, wherein a transporting securing eye that consists of metal is provided and fastened in each case on the pallet top deck of the bottom pallet in all four corner regions externally in front of the bottommost horizontally peripheral lattice tube of the tubular lattice frame.

Since a transportation securing eye that consists of metal is provided and fastened in each case on the pallet top deck of the bottom pallet in all four corner regions externally in front of or at the bottommost horizontally peripheral lattice tube of the tubular lattice frame, a filled pallet container, or a multiplicity thereof, can be lashed down safely for transportation on a truck with the aid of lashing straps, at one end of which a securing hook for hooking into the transportation securing eye is provided, such that said pallet container cannot slip on the load bed of the truck on account of acceleration processes (starting up, braking, road irregularities, potholes).

Expediently, the transportation securing eye is fastened by way of a screw that passes through the bottommost horizontally peripheral lattice tube of the tubular lattice frame in the corner region. This screw is present in any case for fixing the lattice frame and it is possible to dispense with a separate further fastening means for the transportation securing eye.

In a first simple configuration of the invention, provision is made for the transportation securing eye to be provided with a hinge joint and to be formed in a flappable manner. Thus, the transportation securing eye can rest flat on the pallet top deck and is only flapped up when used for hooking in the respective securing hooks of the lashing straps.

In a preferred configuration of the invention, provision is made for the transportation securing eye to be produced in one piece with a fastening tab from a sheet-steel strip and to be provided at its outer rim and in its through-opening in each case with an angled flange rim. In this case, this transportation securing eye together with the fastening tab should have an overall length of approximately 60 mm to 95 mm, preferably approximately 85 mm, an overall width of approximately 55 mm, and a free inside diameter of the through-opening of approximately 20 mm to 40 mm, preferably approximately 30 mm.

The fastening tab is easy to fasten, but a particular feature should be noted, namely that the fastening tab having a bore is angled at right angles to the transportation securing eye and is fitted in a form-fitting manner from the inside under the bottommost horizontally peripheral lattice tube, pressed flat in the corner region, of the tubular lattice frame, and is screw-connected and fastened by means of the fastening screw that passes through the bottommost horizontally peripheral lattice tube of the tubular lattice frame in the corner region. The angled fastening tab initially allows unimpeded screwing in of the fastening screw.

In the mounted state, the transportation securing eye projects upwardly substantially perpendicularly to the pallet top deck and only when the filled pallet containers are loaded is the transportation securing eye bent obliquely in the guyed state with taut lashing straps, such that the angled flange rim, in the lower region of the through-opening, comes to rest against the screw head of the fastening screw screwed in in the corner region and thus covers the screw head and fixes the latter against undesired loosening.

BRIEF DESCRIPTION OF THE DRAWING

The invention is described and explained in more detail in the following text with reference to exemplary embodiments schematically illustrated in the figures of the drawing, in which.

DETAILED DESCRIPTION OF PERFERRED EMBODIMENTS

Figure 1:
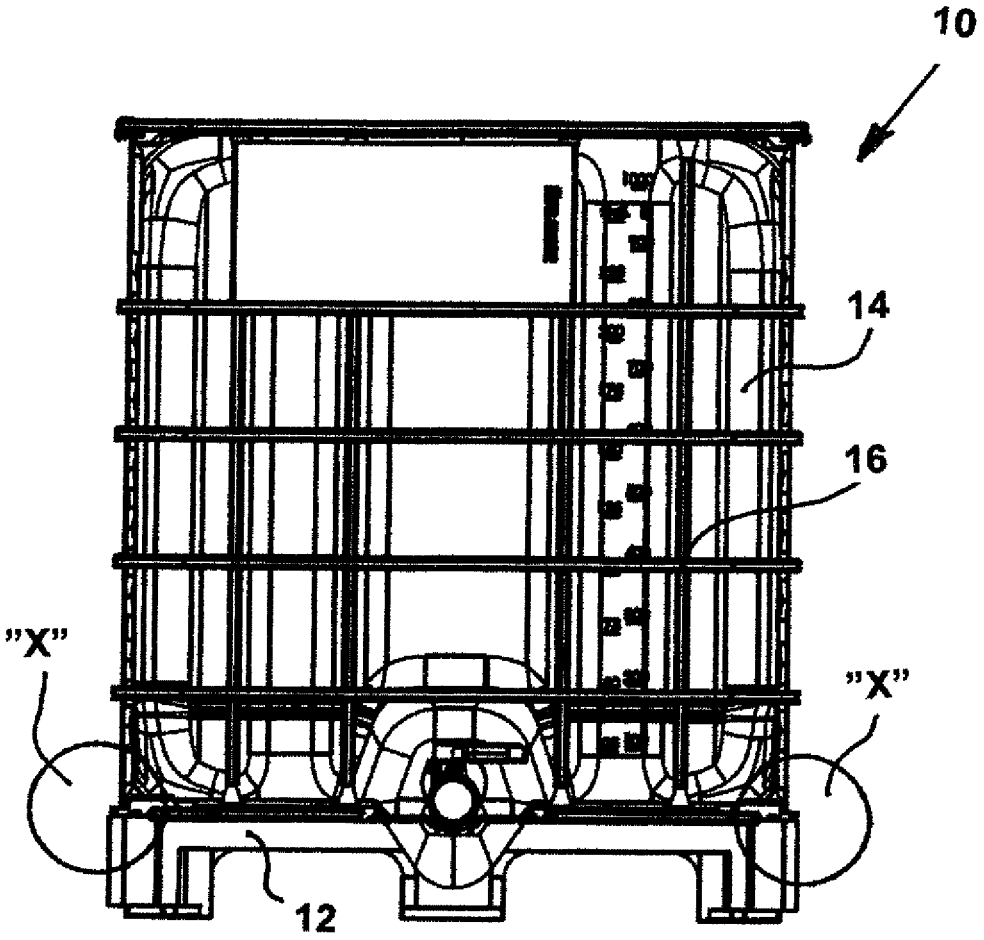
FIG. 1 shows a pallet container according to the invention having particular transportation securing eyes in the corner regions "X"

In FIG. 1, a cuboidal pallet container for storing and transporting in particular hazardous liquid filling materials is designated by the reference numeral 10. The main constituent parts of the pallet container 10 are essentially a bottom pallet 12, a liquid-tight exchangeable plastics inner container 14 and a tubular lattice frame 16 which closely encloses the plastics inner container 14 as a supporting casing. The tubular lattice frame 16 is fastened to the upper outer rim on the pallet top deck of the bottom pallet 12. The filling volumes of such pallet containers are conventionally approximately 1000 liters.

The bottom pallet 12 is embodied here as a pure plastics pallet; however, it could also be a steel pallet, a wooden pallet or a composite pallet (made of steel and plastics material or wood with plastics feet or skids). The corner regions, of importance here, of the pallet container according to the invention having particular transportation securing eyes are marked with a circle "X".

Figure 2A:
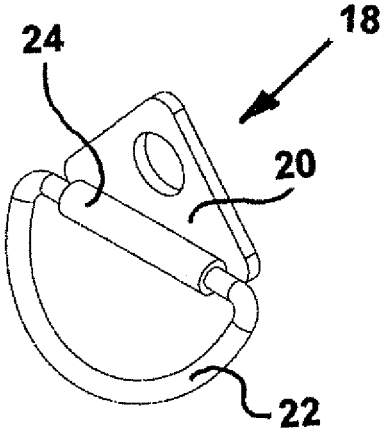
FIGS. 2*a* and 2*b* show a simple embodiment of a transportation securing eye.
Figure 2B:
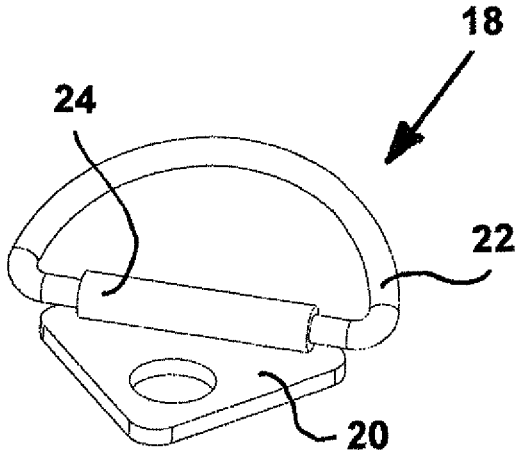

A simple embodiment of a transportation securing eye 18 is illustrated in FIGS. 2*a* and 2*b*. The transportation securing eye 18 has a fastening plate 20 with a retaining ring 22 and is provided with a hinge joint 24 so as to be formed in a flappable manner.

Figure 3:
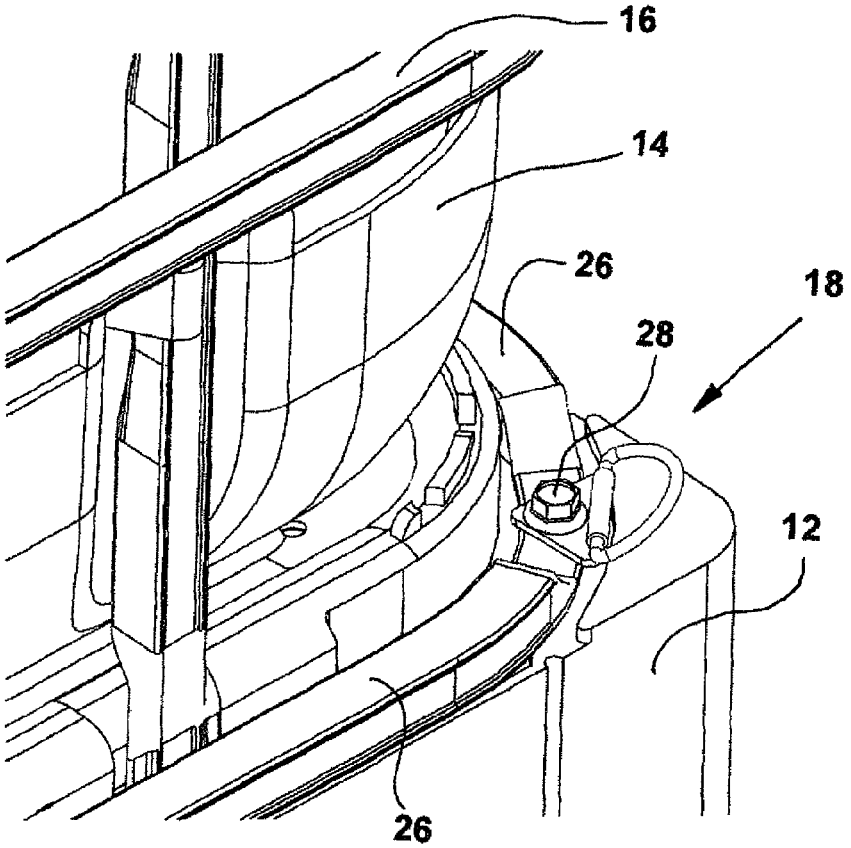
FIG. 3 shows the corner region of a pallet container according to the invention with the transportation securing eyes according to FIGS. 2*a* and 2*b*, FIGS. 4*a*, 4*b*, 4*c* show a preferred embodiment of a transportation securing eye.

FIG. 3 illustrates a detail of the corner region of a pallet container according to the invention with a mounted transportation securing eye 18. A transportation securing eye 18 that consists of metal is provided and fastened in each case on the pallet top deck of the bottom pallet 12 in all four corner regions externally on the bottommost horizontally peripheral lattice tube 26 of the tubular lattice frame 16. The transportation securing eye 18 is fastened in each case by means of a fastening screw 28 that passes through the bottommost horizontally peripheral lattice tube 26 of the tubular lattice frame 16, said fastening screw 28 being plugged through a corresponding bore in the fastening plate 20. The flapped-out retaining ring 22 does not project beyond the outside dimensions of the bottom pallet 12 in the corner regions.

Figure 4:
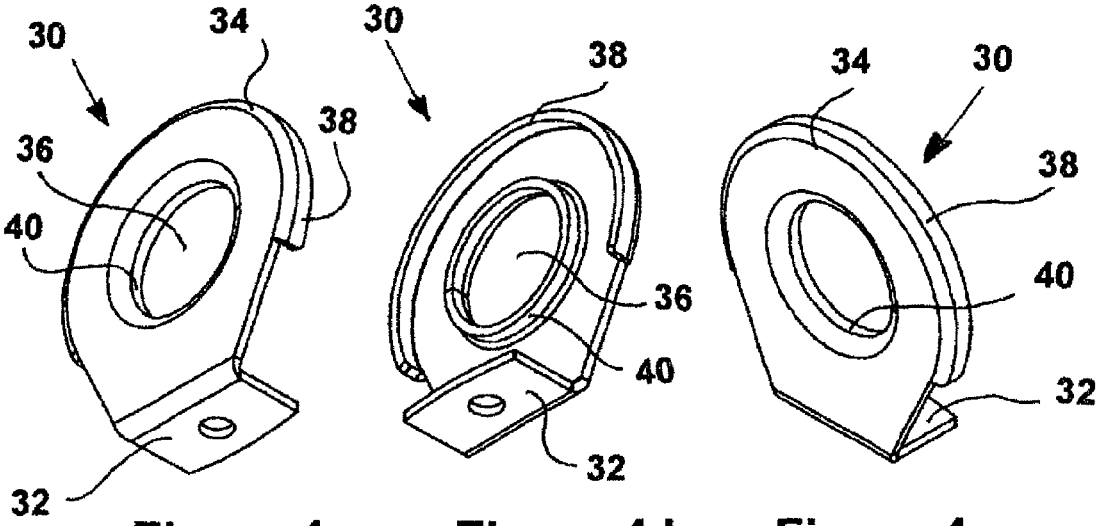

FIGS. 4*a*, 4*b* and 4*c* illustrate various perspective views of a preferred embodiment of a very stable transportation securing eye 30. In constructive terms, the transportation securing eye 30 is produced in one piece with a fastening tab 32 from a sheet-steel strip and is provided at its outer rim 34 and in its through-opening 36 with an angled flange rim 38, 40. In this case, the transportation securing eye 30 together with the fastening tab 32 has an overall length of approximately 60 mm to 95 mm, preferably approximately 85 mm, an overall width of approximately 55 mm and an inside diameter of the through-opening 36 of approximately 20 mm to 40 mm, preferably approximately 30 mm. The thickness of the sheet-steel strip is 2 mm and the flange rims are angled by approximately 3.5 mm.

Figure 5:
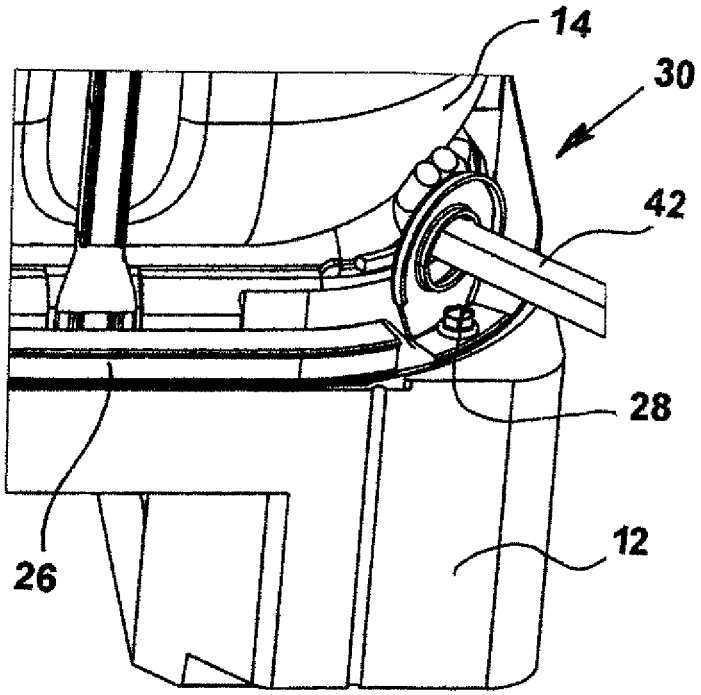
FIG. 5 shows the transportation securing eye according to FIG. 4 in the mounted state in the corner region of a pallet container according to the invention.
Figure 6:
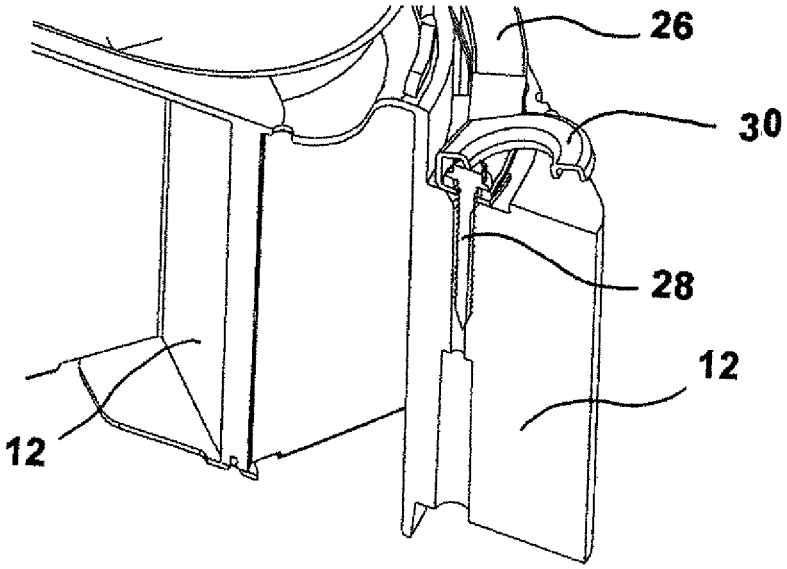
FIG. 6 shows the transportation securing eye according to FIG. 4 and FIG. 5 in the guyed lashed-down state.

As is illustrated in FIG. 5, the particular feature of this advantageous transportation securing eye 30 is now that the fastening tab 32 having a bore is angled at right angles to the transportation securing eye 30 and is fitted in a form-fitting manner from the inside under the bottommost horizontally peripheral lattice tube 26, pressed flat in the corner region, of the tubular lattice frame 16, and is fastened by means of the screw 28 that passes through the bottommost horizontally peripheral lattice tube 26 of the tubular lattice frame 16 in the corner region. In this case, the transportation securing eye 30 projects upwardly substantially perpendicularly to the pallet top deck in the mounted state, in order that the fastening screw 28 passing through can be screwed in in an unimpeded manner. Only in the guyed state of the filled pallet containers loaded on the truck, it being possible for said filled pallet containers to have a weight of well over 1000 kg depending on the filling material, is the transportation securing eye 30 bent obliquely by the hooked-in lashing hooks 42 via the taut lashing straps, such that the angled flange rim 40, in the lower region of the through-opening 36, fits over and comes to rest against the screw head of the fastening screw 28 screwed in in the corner region and thus fixes the screw head, as screw-securing means, against undesired loosening. This guyed state of pallet containers secured properly for transportation is shown in the partially sectional illustration (for improved clarity without the lashing hook) in FIG. 6.

In the lashed-down state, the fastening tab 32 is bent in a U-shaped manner about the bottommost lattice tube 26 and thus serves for broad, extensive introduction of tensile forces from the lashing straps into stable fixed points of the multiply screw-connected bottommost peripheral lattice tube 26 of the tubular lattice frame 16. As a result of the broad force transmission by the wrapping of the bottommost lattice tube, the screw is largely relieved of load and the screw 28 has to bear virtually no tensile-force loading, but rather is pushed further into its screwed-in position by the bent-over transportation securing eye 30. The risk of the fastening screw tearing out or the screw head breaking off is reliably ruled out here—even in the event of jolt-like load impacts.

On account of the angled flange rims at its outer rim and in its through-opening 26, the stability of the transportation securing eye 30 is very substantially increased and the risk of the transportation securing eye itself tearing out is also reliably ruled out. The hooked-in lashing hooks have here not only a linear but also an extensive bearing surface for functional force transmission. With such lashing straps hooked into the four transportation securing eyes of a pallet container, reliable fixing to the load bed of a truck can be realized, with the result that much improved load securing of filled pallet containers can be ensured.

In test drives carried out by DEKRA with corresponding brake tests, quite excellent results were achieved, with not a single secured pallet container of this kind slipping.

Previous solutions for load securing of filled pallet containers consist in fixing the latter with upended wooden pallets in conjunction with anti-slip mats and lashing straps on the load bed of the truck; however, this is comparatively very complicated. With the easy fix system proposed according to the invention herein, no additional pallets which are not present on every truck are required, but rather simple and optimal load securing can be realized with the conventional lashing straps that every truck is equipped with.

What is claimed is:

1. A pallet container for storing and transporting a liquid filling material, said pallet container comprising:

a bottom pallet having a pallet top deck;

an exchangeable plastics inner container;

a supporting casing configured to closely enclose the inner container and made of a tubular lattice frame which is fastened to an upper outer rim of the pallet top deck;

transportation securing eyes provided on the pallet top deck of the bottom pallet in all four corner regions in one-to-one correspondence externally in front of a bottommost horizontally peripheral lattice tube of the tubular lattice frame, each said transportation securing eye being made of metal and fastened by a fastening screw sized to pass through the bottommost horizontally peripheral lattice tube of the tubular lattice frame in the corner region, and wherein the transportation securing eye is made in one piece from a sheet-steel strip and has an outer rim which is provided with a first flange rim, and a through-opening which is collared with a second flange rim.

2. The pallet container of claim 1, wherein the bottom pallet has a rectangular configuration.

3. The pallet container of claim 1, wherein the transportation securing eye has a fastening plate, a retaining ring, and a hinge joint swingably connecting the retaining ring to the fastening plate.

4. The pallet container of claim 1, wherein the transportation securing eye together with the fastening tab has an overall length of approximately 60 mm to 95 mm, said through-opening being defined by a free inside diameter of approximately 20 mm to 40 mm.

5. The pallet container of claim 4, wherein the length is approximately 85 mm, and the inside diameter is approximately 30 mm.

6. The pallet container of claim 1, wherein the fastening tab has a bore and is angled at a right angle to the transportation securing eye, said fastening tab being placed in a form-fitting manner from inside under a flat portion of the bottommost horizontally peripheral lattice tube in the corner region and fastened by the fastening screw that passes through the bottommost horizontally peripheral lattice tube of the tubular lattice frame in the corner region.

7. The pallet container of claim 1, wherein the transportation securing eye is sized to project upwardly substantially perpendicularly to the pallet top deck in a mounted state and is bent by taut lashing straps in a guyed state such that the second flange rim in a lower region of the through-opening rests against a screw head of the threadably engaged fastening screw in the corner region to thereby cover the screw head and fixing the screw head against undesired loosening.

8. A pallet container for storing and transporting a liquid filling material, said pallet container comprising:

a bottom pallet having a pallet top deck;

an exchangeable plastics inner container;

a supporting casing configured to closely enclose the inner container and made of a tubular lattice frame which is fastened to an upper outer rim of the pallet top deck; and transportation securing eyes provided on the pallet top deck of the bottom pallet in all four corner regions in one-to-one correspondence externally in front of a bottommost horizontally peripheral lattice tube of the tubular lattice frame, each said transportation securing eye being made of metal and having a fastening member fastened by a fastening screw sized to pass through the bottommost horizontally peripheral lattice tube of the tubular lattice frame in the corner region and a retaining member extending from the fastening member, wherein the transportation securing eye is made in one piece from a sheet-steel strip and has the fastening member constructed as a fastening tab and the retaining member constructed as an outer rim which is provided with a first flange rim, and a through-opening which is collared with a second flange rim.

* * * * *